US005718005A

United States Patent [19]

Ng

[11] Patent Number: 5,718,005

[45] Date of Patent: Feb. 17, 1998

[54] FOUL AIR REMOVER FOR TOILET SYSTEM

[76] Inventor: KamSik Ng, 1941 Sandcreek Way, Alameda, Calif. 94501

[21] Appl. No.: 540,289

[22] Filed: Oct. 6, 1995

[51] Int. Cl.[6] ..... E03D 9/052

[52] U.S. Cl. ..... 4/213

[58] Field of Search ..... 4/209 FF, 213, 4/225.1, 227.1, 228.1

[56] References Cited

U.S. PATENT DOCUMENTS

| | | | |
|---|---|---|---|
| 4,165,544 | 8/1979 | Barry | 4/213 |
| 4,166,298 | 9/1979 | Pearson | 4/213 |
| 4,168,550 | 9/1979 | Lindauer | 4/228.1 |
| 4,864,664 | 9/1989 | Higgins | 4/213 |
| 5,125,119 | 6/1992 | Munoz | 4/213 |
| 5,369,810 | 12/1994 | Warren | 4/213 |
| 5,493,737 | 2/1996 | Chu | 4/213 |

FOREIGN PATENT DOCUMENTS

| | | | |
|---|---|---|---|
| 0081432 | 4/1991 | Japan | 4/209 FF |

*Primary Examiner*—Charles E. Phillips

*Attorney, Agent, or Firm*—Majestic, Parsons, Siebert & Hsue, P.C.

[57] ABSTRACT

A foul air remover is placed inside the tank of an ordinary toilet system having a water intake assembly for introducing water into the tank, a flushing water discharge pipe connecting the tank with a toilet bowl, a plunger normally keeping the flushing water discharge pipe closed, and an overflow pipe with an open upper end above the water level inside the tank and connected to the flushing water discharge pipe at the lower end such that foul air in the toilet bowl can be brought inside the tank therethrough. The foul air remover has an air intake chamber connected to the open upper end of the overflow pipe, a deodorizing chamber and a partition therebetween incorporating a fan for drawing foul air from the toilet bowl through the water discharge and overflow pipes and the air intake chamber into the deodorizing chamber where the foul air contacts an odor-destroying liquid. A similar combination of a foul air remover and a tank may be connected to the discharge pipe of a toilet system of a so-called institutional type through a connecting pipe equipped with a check valve which is normally open to allow foul air to be drawn therethrough to the foul air remover but is closed when the toilet is flushed.

11 Claims, 5 Drawing Sheets

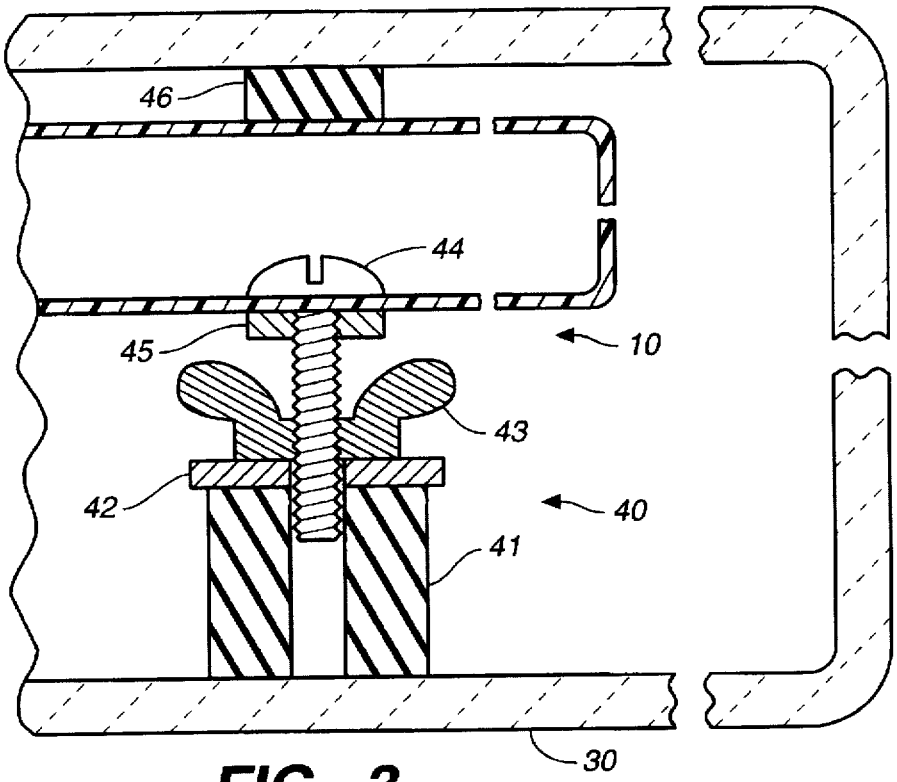
FIG._3
FIG._4
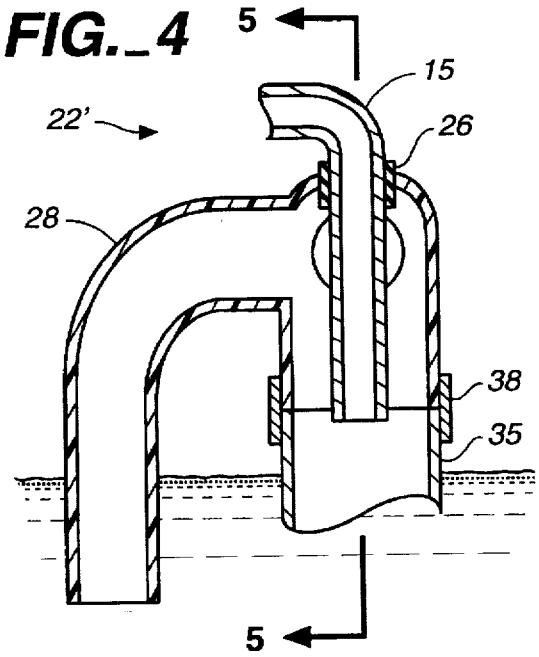
FIG._5
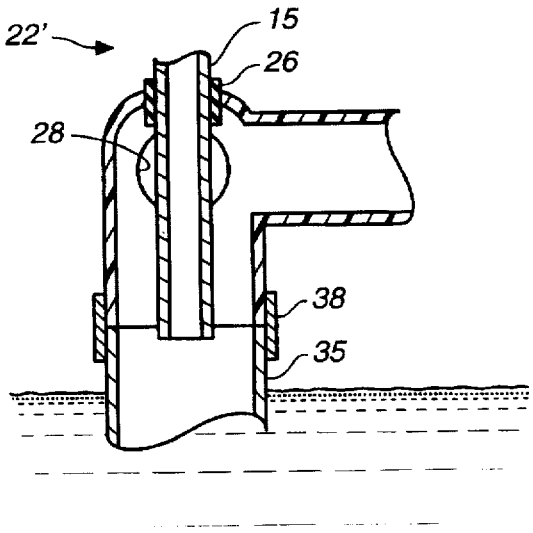

FOUL AIR REMOVER FOR TOILET SYSTEM

BACKGROUND OF THE INVENTION

This invention relates to the removal of unpleasant odors from the air in a bathroom and, more particularly, to a device for drawing in odorous air from a toilet bowl for purification and returning the processed air back to the bathroom environment.

Many toilets are located in a room without an exhaust fan. Even if the bathroom is provided with an exhaust fan, the odorous air generated in the toilet bowl is first diffused throughout the bathroom before reaching the exhaust fan. Thus, many toilet systems have been proposed for drawing odorous air directly from the toilet bowl into a deodorizing device incorporated therein, but prior art systems of this kind have disadvantages and/or drawbacks such as being ineffective, impractical and/or expensive to install. For example, the use of a charcoal filter has been suggested in many patents including U.S. Pat. Nos. 5,231,705 and 5,369,813, but a charcoal filter removes odor by adsorption. If the filter is too thin, it is not effective. If the filter is too thick, on the other hand, a powerful fan is required to push the air therethrough. Since the moisture level of air inside a toilet bowl is generally quite high, the charcoal filters become wet quickly, and this also affects the air flow through the filter adversely.

U.S. Pat. No. 5,083,322 disclosed a water tank having two compartments, one for the storage of water and the other containing a pump for drawing air from the toilet bowl. This means that an entire new toilet system is needed. U.S. Pat. Nos. 4,165,544 and 5,253,371 disclosed devices adapted to draw air from the toilet bowl and to discharge it into a vent behind the bathroom wall. Such a device will be too expensive to install because a portion of the bathroom wall will have to be cut open and repaired after the installation. U.S. Pat. No. 5,054,130 disclosed a method of creating a vacuum inside the toilet tank such that foul air can be drawn from the toilet bowl thereinto through its overflow pipe. An air-tight handle, however, is not only expensive to manufacture but is easily jammed. U.S. Pat. Nos. 5,161,262 and 5,345,617 disclosed attaching various device components onto the back of the toilet bowl, but this presents a sanitary problem because it becomes difficult to clean this part of the toilet bowl without first removing the attached device.

SUMMARY OF THE INVENTION

It is therefore an object of this invention to provide a simple, efficient and practical device for removing foul air from a toilet bowl.

It is another object to provide such a device which can be installed inexpensively.

It is still another object to provide a toilet system incorporating such a device.

A foul air remover for a toilet system embodying this invention, with which the above and other objects can be accomplished, may be characterized as having an air intake chamber and a deodorizing chamber sandwiching therebetween a partitioning member including a ventilating means such as an electric fan such that foul air from a toilet bowl can be drawn into the air intake chamber and from there into the deodorizing chamber which is partially filled with an odor-destroying liquid. Such a foul air remover may be installed inside the water tank of an ordinary toilet system provided with a water intake assembly for introducing water into the tank and stopping the intake when a specified level is reached, a flushing water discharge pipe connecting the tank to a toilet bowl and equipped with a plunger which normally keeps the water stored in the tank from flushing down therethrough and an overflow pipe through which foul air from the toilet bowl can be introduced into the foul air remover while the plunger keeps the water discharge pipe in the closed condition. The open top end of the overflow pipe may be positioned outside the foul air remover and connected through a connecting pipe to an inlet opening into the air intake chamber. In such a case, a refill water inlet tube with one end connected to the water intake assembly penetrates the connecting pipe so as to be able to deliver water therethrough into the overflow pipe. The overflow pipe may penetrate the foul air remover to have its open top end positioned inside its air intake chamber. In this case, the refill water inlet tube also penetrates the foul air remover. An odor-destroying material such as dry bleach may be placed inside the tank or inside the deodorizing chamber to provide a deodorizing liquid which will partially fill the deodorizing chamber and come into contact with the foul air.

A foul air remover of this invention can be used also with a toilet system of the so-called institutional type having no water tank for flushing each toilet bowl. For this application, a foul air remover structured substantially as described above with an air intake chamber and a deodorizing chamber sandwiching a fan therebetween, is placed inside a tank which is also structured substantially like but need not be as large as the water tank described above, containing a deodorizing liquid and connected to the discharge pipe of the toilet system through a T-shaped pipe with a branch provided with a normally open check valve such that foul air from the toilet bowl can be drawn into the foul air remover but the valve will close when the toilet is flushed.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 3 is a top sectional view of a portion of the water tank and foul air remover of FIG. 2 showing means for affixing the foul air remover at a specified position inside the tank;

FIG. 4 is a sectional horizontal view of an alternative elbow which may be employed for connecting the foul air remover of FIGS. 1 and 2;

FIG. 5 is another sectional view of the alternative elbow of FIG. 4 taken along line 5—5 of FIG. 4;

Throughout herein, those components which are equivalent to each other, although used in different embodiments of the invention, are indicated by the same numeral and the description will not be repeated.

DETAILED DESCRIPTION OF THE INVENTION

Figure 1:
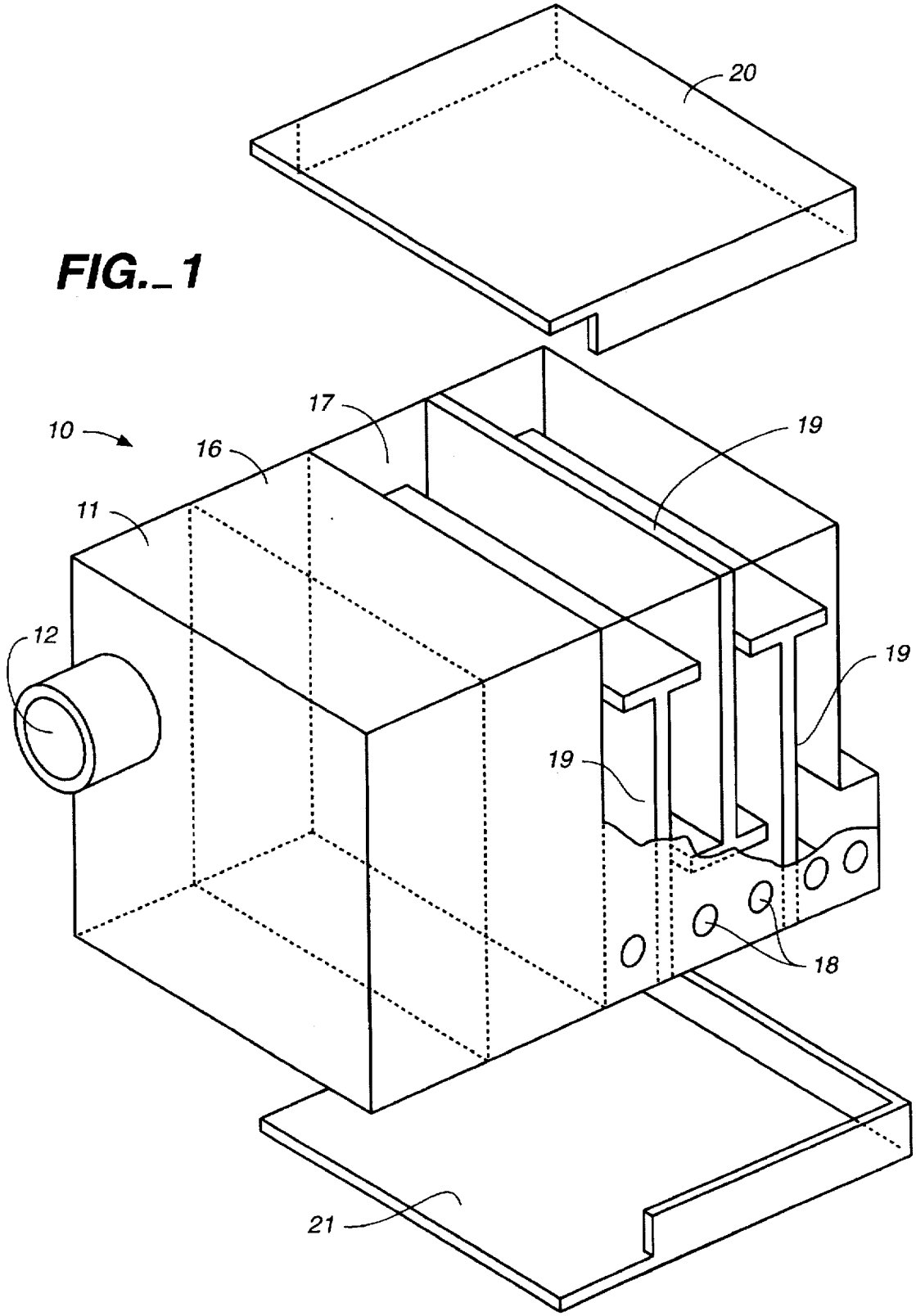
FIG. 1 is a schematic diagonal external view of a foul air remover embodying this invention with a portion of its side wall removed to show a portion of its interior and with its cover and bottom disassembled from the rest.

As shown schematically in FIG. 1, a foul air remover 10 according to this invention may be characterized as being a box-like structure with a lid 20 and a bottom 21 which are removable, having within its housing an air intake chamber 11, a deodorizing chamber 17 and a partitioning member 16 therebetween. The air intake chamber 11 has an air inlet 12 at an elevated position for admitting foul air into the air intake chamber 11 therethrough. The partitioning member 16 includes an electric fan for sucking foul air into the intake chamber 11 through the air inlet 12 and forcing it into the deodorizing chamber 17. The fan may be a typical computer-cooling fan operable at 12V DC and 0.5 amperes with dimensions of 100 mm×100 mm×25 mm. Small holes 18 are formed at lower positions on the side walls of the deodorizing chamber 17 for allowing water to come into and leave from the deodorizing chamber 17 when the bottom 21 is attached. Baffles 19 are provided inside the deodorizing chamber 17 so as to increase the contact between the foul air introduced through the partitioning member 16 and an odor-destroying liquid partially filling the deodorizing chamber 17. Some of these baffles 19 may be attached to the lid 20 or the bottom 21 for easy manufacturing. The exact shapes and positions of the baffles 19 are not intended to limit the scope of the invention.

Figure 2:
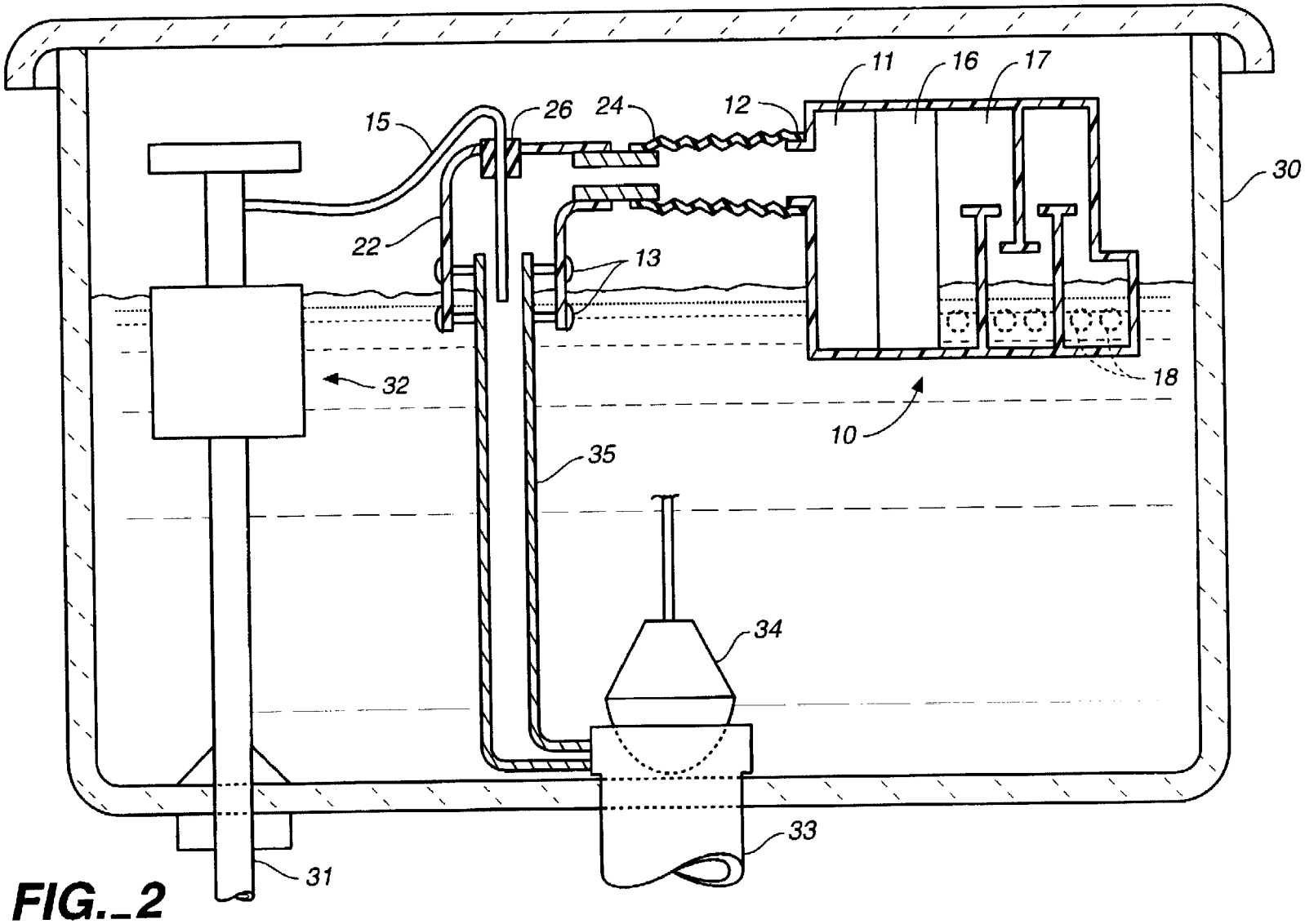
FIG. 2 is a schematic sectional front view of a portion of a water tank of a toilet system incorporating the foul air remover shown in FIG. 1.

FIG. 2 shows how the foul air remover 10, as described above, can be installed in a water tank 30 of an ordinary kind having a water intake pipe 31 through which water is introduced thereinto, an intake control assembly 32 of a known kind for stopping the intake of water through the intake pipe 31 when the water inside the tank 30 reaches a predetermined level, a water discharge pipe 33 connected to the toilet bowl (not shown), a plunger (a "tank ball" or a "flapper" ) 34 attached to a lever (not shown) through a chain or a lift wire (shown only in part) for keeping the top end of the discharge pipe 33 normally closed and allowing the toilet bowl to be flushed when it is opened, and an overflow pipe 35 with its open top end at a position above the aforementioned predetermined water level and its bottom end connected to the water discharge pipe 33 such that foul air in the toilet bowl can be taken into the tank 30 even when the plunger keeps the water discharge pipe 33 closed at the top.

The foul air remover 10 is positioned inside the tank 30 such that the air inlet 12 on the air intake chamber 11 is above the aforementioned water level but the small holes 18 on the side walls of the deodorizing chamber 17 are therebelow. The open top end of the overflow pipe 35 is connected to the air inlet 12 through an L-shaped pipe 22 with a 90-degree bend which may be of a kind commonly available at a hardware store, referred to as an elbow. The elbow 22 may be directly connected to the air inlet 12 or through a connecting tube 24 serving as an air conduit. The connecting tube 24 may be a rubber tube or a corrugated plastic hose. If the elbow 22 and the connecting tube 24 are not of the same diameter, a diameter-reducing coupler of any known kind may be used therebetween. A refill water inlet tube 15, connected at one end to the water intake pipe 31 through the intake control assembly 32, penetrates the elbow 22 through an inlet seal 26 with the other end opening into the open top end of the overflow pipe 35. The inlet seal 26 may be made of a flexible material such as rubber. Locking bolts 13, such as regular plastic bolts, are used to fasten the bottom end of the elbow 22 to the top end of the overflow pipe 35 with a space therebetween. For the convenience of illustration, neither the electric fan incorporated in the partitioning member 16 nor its power source placed outside the tank 30 and connected thereto by a wire is shown in FIG. 2.

FIG. 3 shows a preferred manner for securing the foul air remover 10 at a selected position inside the tank 30 as shown in FIG. 2. Since it is desirable that the foul air remover 10 can be secured inside tanks of different sizes, used is made, according to a preferred embodiment of the invention, of locking devices 40 of which the length can be adjusted according to the sizes of the tank 30 and the foul air remover 10, or according to the width of the space between the front outer surface of the foul air remover 10 and the inner surface of the front wall of the tank 30 after spacers 46 are inserted between the back wall of the foul air remover 10 and the back inner wall of the tank 30. The locking device 40 with an adjustable length includes a tubular spacer 41 made of an elastic material such as rubber, one end of which is adapted to be pressed against the inner wall of the tank 30. A butterfly nut 43 is attached to the other end of the tubular spacer 41 through a washer 42, and a bolt 44 is engagingly inserted therethrough. The foul air remover 10 is provided with bolt-accepting holes (not shown in FIG. 1) on its front wall, through a suitable one of which the bolt 44 is passed and fastened to it by means of a nut 45. The butterfly nut 43 is rotated for adjusting the distance by which the bolt 44 penetrates the tubular spacer 41, that is, to adjust the total length of the locking device 40 according to the width of the space between the front walls of the foul air remover 10 and the tank 30 and to the tension with which the locking device 40 is to be compressed therebetween. Because the foul air remover 10 according to this invention is relatively light, two of such locking devices 40 are usually sufficient, and the tension inside the tubular spacer need not be too large.

FIGS. 4 and 5 show another elbow 22' which may be used for connecting the air inlet 12 of the foul air remover 10 to the overflow pipe 35. This alternative elbow 22' is characterized as being adapted to be directly attached to the open top end of the overflow pipe 35, say, by means of a connecting sleeve 38 of any known kind without leaving any space therebetween and having a branch pipe 28 with an open end adapted to be positioned below the water level in the tank 30.

Figure 6:
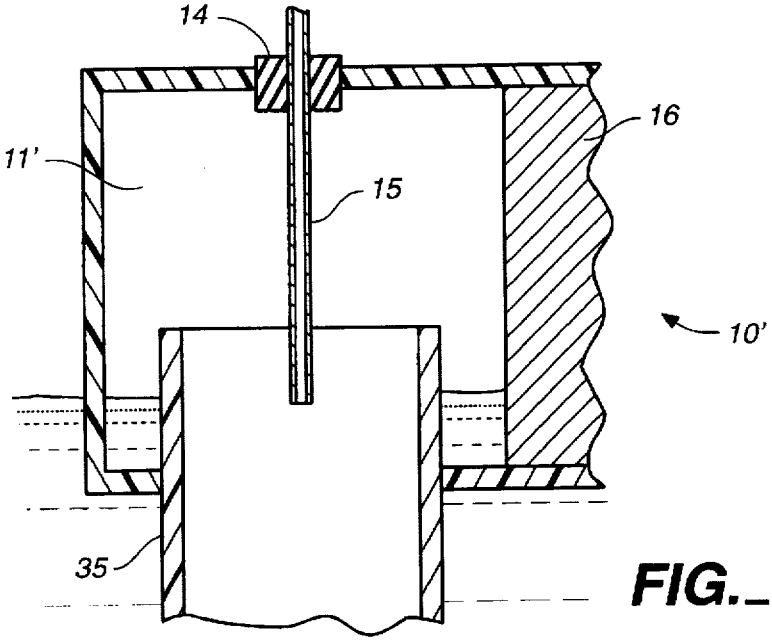
FIG. 6 is a schematic sectional front view of a portion of another foul air remover embodying the invention where it is connected to the overflow pipe.

The manner of introducing foul air through the overflow pipe 35 into the foul air remover is not intended to limit the scope of the invention. FIG. 6 shows a portion of another foul air remover 10' embodying this invention, characterized as having the open top end of the overflow pipe 35 inside its air intake chamber 11'. The partitioning member 16 and the deodorizing chamber 17 may be structured substantially as described above with reference to FIGS. 1 and 2 and hence are omitted from FIG. 6. The intake chamber 11' is open at the bottom, and the overflow pipe 35 is passed therethrough with its open top end inside the intake chamber 11'. The refill water inlet tube 15 is made of a flexible material such as rubber such that its open end can be adjustably positioned with respect to the open top end of the overflow pipe 35, and penetrates the ceiling of the intake chamber 11'. An inlet seal 14 is provided to seal the refill water inlet 15 where it penetrates the ceiling of the intake chamber 11' against the foul air introduced through the discharge pipe 33 and the overflow pipe 35.

The foul air removers 10 and 10' according to this invention may be used either with the bottom 21 removed and by keeping chemically treated water all the time in the tank 30 or with the bottom 21 attached and by furnishing an odor-destroying material inside the deodorizing chamber 17 although these two modes of use are not separately illustrated. For the latter mode of use, dry bleach of the kind which is commonly used in swimming pools provides good results, lasting for a long time, say, for weeks. For providing a new supply, the removable lid 20 is lifted from the deodorizing chamber 17. This method is advantageous in that a localized high concentration of an odor-destroying material is obtained and, when the toilet is flushed, its solution leaves the deodorizing chamber 17 through the small holes 18 and serves to clean the toilet bowl connected to the discharge pipe 33.

Figure 7:
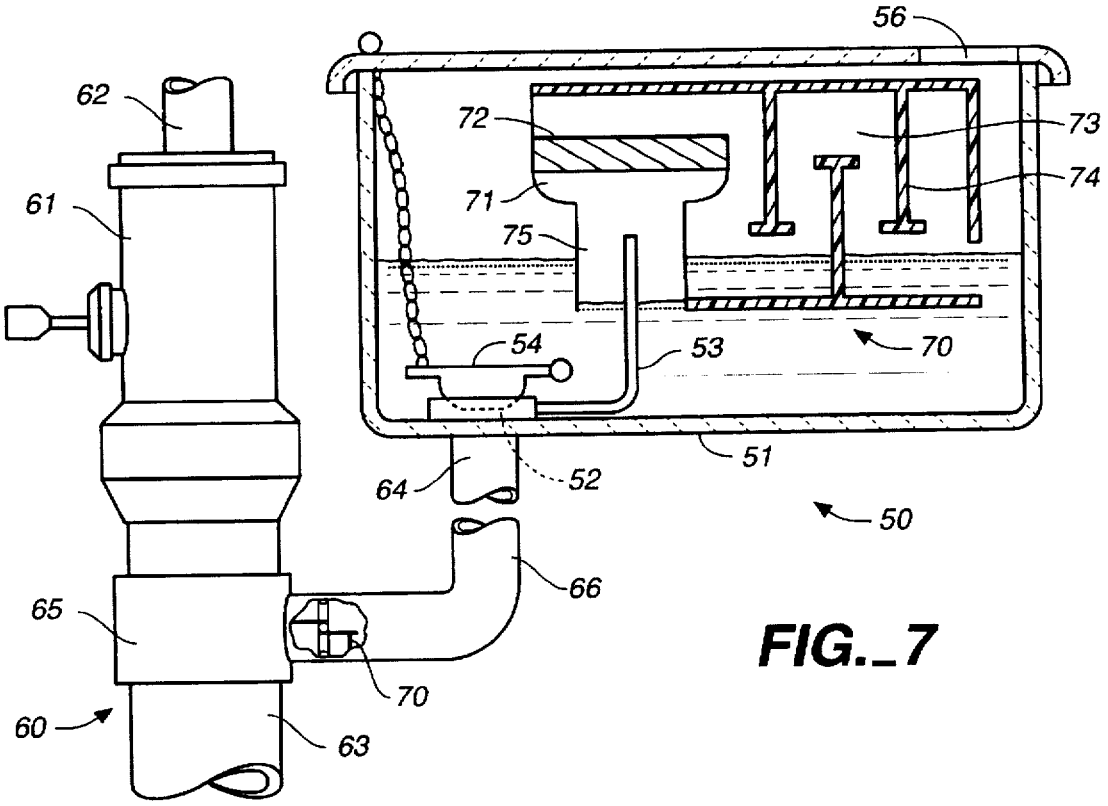
FIG. 7 is a schematic sectional front view of still another foul air remover embodying the invention adapted to be used for a toilet system of a so-called institutional type.

FIG. 7 shows still another foul air remover 50 embodying the invention for use with a toilet system of the kind sometimes referred to as an institutional type, not having a water tank for each toilet bowl, most frequently employed in office and other public buildings. In this type of toilet system, shown generally at 60 in FIG. 7, a flush valve 61 with a handle is inserted between a water-supply pipe 62 connected to a water source (not shown) and a discharge pipe 63 connected to the toilet bowl (not shown). The foul air remover 50 according to this embodiment of the invention comprises a water tank 51 which is for holding therein a deodorizing liquid and hence is much smaller than the water tank of the kind shown at 30 in FIG. 2. A foul air inlet pipe 64 is connected to a bottom opening 52 of the tank 51 with its open top end normally closed by a plunger 54 which is manually operable by a chain attached thereto. A vertically elongated overflow pipe 53 leads to the air inlet pipe 64 similarly to the way in which the overflow pipe 35 is connected to the discharge pipe 33 as shown in FIG. 2. The open top end of the overflow pipe 53 is positioned at or above the level of the deodorizing liquid inside the tank 51 such that excess water poured into the tank 51 will flow into the bowl and the water level inside the tank 51 is thereby regulated.

Inside the tank 51 is a structure 70, substantially like the foul air remover 10' described above, comprising an air intake chamber 71, a deodorizing chamber 73 with baffles 74 and a partitioning member 72 sandwiched therebetween incorporating a ventilating means (not shown) for causing an air flow therethrough from the air intake chamber 71 into the deodorizing chamber 73. The ventilating means comprise an electric fan (although neither the fan nor its power source connected thereto by a wire and placed outside the tank 51 is illustrated in FIG. 7). The intake chamber 71 has an air inlet 75 which surrounds the open top end of the overflow pipe 53 under the water level with a space between the outer surface of the overflow pipe 53 and the inner surface of the air inlet 75. The partitioning member 72 is disposed horizontally for allowing the structure 70 to be made compact, and the deodorizing chamber 73 is of an open bottom structure such that foul air introduced thereinto through the partitioning member 72 can be forced to come into contact efficiently with the deodorizing water inside the tank 51. Numeral 56 indicates a top opening for the tank 51 for water and chemical needed for deodorizing.

The air inlet pipe 64 is connected to the toilet system 60 by inserting a T-shaped pipe 65 with a branch between the flush valve 61 and the discharge pipe 63. A J-shaped pipe 66 containing a check valve assembly 80, as shown more in detail in FIG. 9, is attached to the branch of the T-shaped pipe 65 and at the other end to the air inlet pipe 64. Depending on the circumstance, a single pipe may be used for the J-shaped pipe 66 and the air inlet pipe 64.

Figure 8:
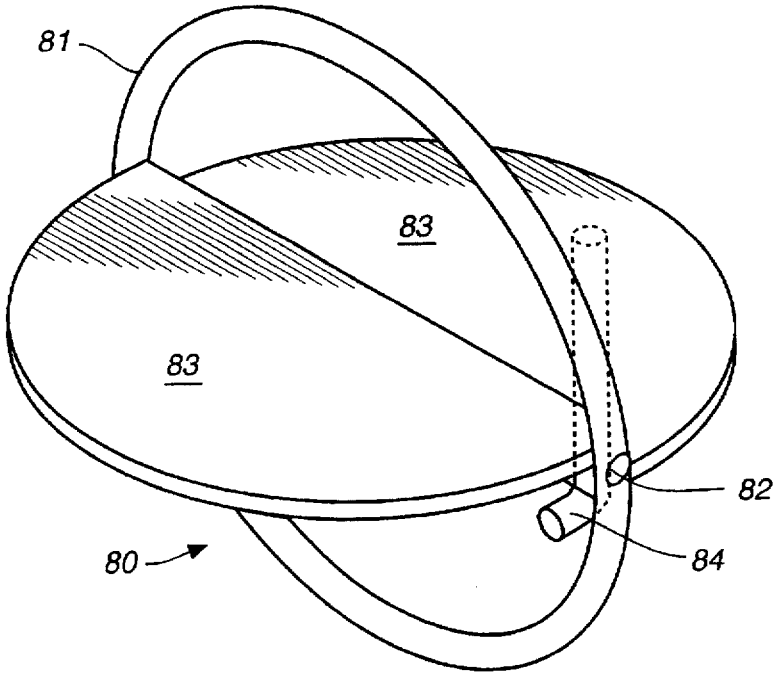
FIG. 8 is a diagonal view of the check valve assembly of FIG. 7.

As shown in FIG. 8, the check valve assembly 80 may be of a kind with a ring structure 81 supporting a rotatable axis 82 to which a rotatable member 83 is attached. A support leg 84 which is an elongated member with length approximately equal to the radius of the J-shaped pipe 66 inside which it is installed is attached to one end of the rotatable member 83. For improved efficiency, the rotatable member has two planar semicircular parts which are parallel to each other but not coplanar, as shown in FIG. 8.

Figure 9A:
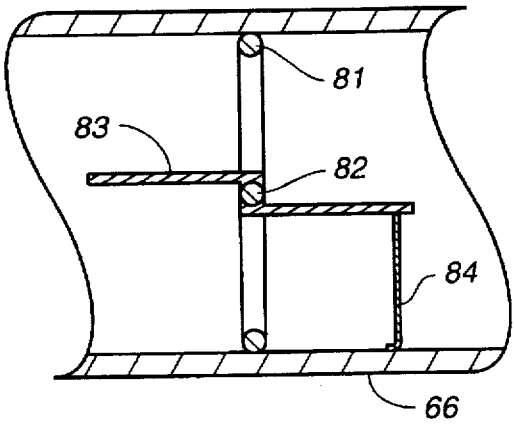
FIGS. 9A and 9B are sectional view of the check valve assembly of FIG. 7 when it is in open condition and in closed condition, respectively.
Figure 9B:
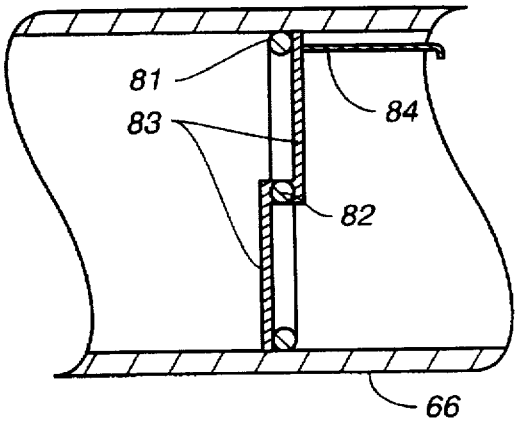

Because of the weight of the support leg 84, the planar rotatable member 83 is normally in a horizontal position, as shown in FIG. 9A, leaving the J-shaped pipe 66 in an open condition and thereby allowing foul air from the toilet bowl to pass through the J-shaped pipe 66 and into the foul air remover 50. When the handle on the flush valve 61 is operated to flush the toilet, the flushing water pushes the rotatable member 83 so as to cause it to assume a vertical closed position as shown in FIG. 9B, preventing the water from passing therethrough and entering the tank 51.

The invention has been described above with reference to only a limited number of embodiments but these illustrated examples are intended to be merely illustrative. Many modifications and variations are possible within the scope of the invention. For example, the fan, serving as the ventilating means, may be adapted to be controlled by a simple manual switch and a timer, a pressure-sensitive switch, a photosensitive switch or a magnetic switch installed on the bathroom door.

One of the advantages of the invention is its applicability to toilet systems of many different types by using inexpensive, commonly available components. If a flexible material is used for the connecting tube 26 of FIG. 2, for example, this makes the selection much easier in the positioning of the foul air remover 10 even if the tank 30 is relatively small. If the position of the overflow pipe 35 is inconvenient for the purpose of finding a space for the foul air remover 10, an offset pipe of a known kind may be inserted between the water discharge pipe 33 and the overflow pipe 35, say, by using a commonly available locking sleeve means for connecting pipes together. In summary, the disclosure is intended to be interpreted broadly, and such modifications and variations of the disclosed examples that may be apparent to a person skilled in the art are intended to be within the scope of the invention.

What is claimed is:

1. A foul air remover for a toilet system comprising:

an air intake chamber connected to a toilet bowl;

a deodorizing chamber adapted to be at least partially immersed in water during a normal operation of said toilet system;

ventilating means disposed between said air intake chamber and said deodorizing chamber for drawing air from said toilet bowl through said air intake chamber into said deodorizing chamber;

a deodorizing material, which is an aqueous solution of an odor-destroying substance, capable of deodorizing foul air by contact and occupying a part of said deodorizing chamber; and baffles disposed inside said deodorizing chamber for improving contact between the air drawn into said deodorizing chamber and said deodorizing material.

2. The foul air remover of claim 1 wherein said ventilating means comprises an electric fan.

3. A foul air remover for a toilet system comprising:

an air intake chamber connected to a toilet bowl;

a deodorizing chamber which contains a dry breach, is adapted to be at least partially immersed in water during a normal operation of said toilet system and is provided with openings for allowing water to enter and leave said deodorizing chamber;

ventilating means disposed between said air intake chamber and said deodorizing chamber for drawing air from said toilet bowl through said air intake chamber into said deodorizing chamber;

a deodorizing material capable of deodorizing foul air by contact and occupying a part of said deodorizing chamber; and baffles disposed inside said deodorizing chamber for improving contact between the air drawn into said deodorizing chamber and said deodorizing material.

4. A toilet system with means for removing foul air, said toilet system comprising:

a tank for containing toilet-flushing water therein;

a foul air remover positioned inside said tank, said foul air remover having an air intake chamber with an air inlet, a deodorizing chamber adapted to be at least partially immersed in said toilet-flushing water and ventilating means disposed between said air intake chamber and said deodorizing chamber for drawing foul air through said air inlet into said air intake chamber and further into said deodorizing chamber, said deodorizing chamber being adapted to admit a portion of said toilet-flushing water therein and deodorizing foul air received through said intake chamber;

a water intake assembly for introducing water into said tank until a specified water level is reached;

a flushing water discharge pipe connecting said tank to a toilet bowl;

a plunger normally closing said flushing water discharge pipe to prevent water inside said tank from flowing down through said flushing water discharge pipe; and an overflow pipe having a lower end connected to said flushing water discharge pipe and an open upper end above said specified water level wherein said foul air remover is capable of receiving foul air from said toilet bowl through said overflow pipe when said flushing water discharge pipe is closed by said plunger.

5. The toilet system of claim 4 wherein said deodorizing chamber contains a dry breach and is provided with openings for allowing water to enter and leave said deodorizing chamber.

6. The toilet system of claim 4 further comprising a refill water inlet tube connected and having an outlet positioned so as to drop water received from said intake assembly into said overflow pipe.

7. The toilet system of claim 4 wherein said ventilating means comprises an electric fan.

8. The toilet system of claim 4 wherein said deodorizing chamber contains baffles for improving contact between air and water inside said deodorizing chamber.

9. The toilet system of claim 6 wherein said open upper end of said overflow pipe is outside said foul air remover, said toilet system further comprising an air conduit with an outlet opening connected to said air inlet and an inlet opening surrounding said open upper end of said overflow pipe below said specified water level.

10. The toilet system of claim 9 wherein said refill water inlet tube penetrates said air conduit, said outlet of said refill water inlet tube being inside said air conduit.

11. The toilet system of claim 9 wherein said air conduit has a branch with an opening below said specified water level.

* * * * *